US007835849B2

(12) United States Patent
Rieder et al.

(10) Patent No.: US 7,835,849 B2
(45) Date of Patent: Nov. 16, 2010

(54) METHOD AND DEVICE FOR OPERATING AN INTERNAL COMBUSTION ENGINE

(75) Inventors: Gerald Rieder, Freising (DE); Paul Rodatz, Landshut (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 12/369,197

(22) Filed: Feb. 11, 2009

(65) Prior Publication Data

US 2009/0210130 A1 Aug. 20, 2009

(30) Foreign Application Priority Data

Feb. 14, 2008 (DE) ..... 10 2008 009 033

(51) Int. Cl.
*F02D 41/30* (2006.01)

(52) U.S. Cl. ..... 701/103; 123/672; 123/676

(58) Field of Classification Search ..... 123/435, 123/672, 676, 697; 701/103, 102, 104–105, 701/109, 111; 60/285
See application file for complete search history.

(56) References Cited

U.S. PATENT DOCUMENTS

| | | | | |
|---|---|---|---|---|
| 4,765,300 | A | 8/1988 | Fujimura et al. | 123/491 |
| 5,367,462 | A * | 11/1994 | Klenk et al. | 701/104 |
| 5,638,800 | A | 6/1997 | Furuya et al. | 123/674 |
| 5,647,668 | A * | 7/1997 | Schnaibel et al. | 374/144 |
| 5,817,923 | A | 10/1998 | Ohsaki et al. | 73/35.02 |
| 6,951,205 | B2 | 10/2005 | Joos et al. | 123/491 |
| 7,191,771 | B2 | 3/2007 | Ketterer et al. | 123/674 |
| 2008/0201057 | A1 | 8/2008 | Aliakbarzadeh et al. | 701/103 |
| 2008/0210200 | A1 * | 9/2008 | Cwielong et al. | 123/459 |
| 2009/0030591 | A1 * | 1/2009 | Rieder et al. | 701/106 |
| 2009/0210136 | A1 | 8/2009 | Rieder et al. | 701/103 |
| 2009/0301066 | A1 * | 12/2009 | Sindano et al. | 60/286 |
| 2009/0306877 | A1 * | 12/2009 | Sasaki et al. | 701/104 |

FOREIGN PATENT DOCUMENTS

| | | | |
|---|---|---|---|
| DE | 19545924 | A1 | 6/1996 |
| DE | 19702556 | A1 | 7/1997 |
| DE | 10221337 | A1 | 11/2003 |
| DE | 10252423 | A1 | 5/2004 |
| DE | 10307004 | B3 | 8/2004 |
| DE | 102005009101 | B3 | 3/2006 |
| DE | 102006043702 | B3 | 7/2007 |
| DE | 102007028380 | A1 | 1/2008 |

* cited by examiner

OTHER PUBLICATIONS

Basshuysen, Richard, et al., "Handbuch Verbrennungsmotor", Vieweg & Sohn Verlagsgesellschaft mbH, 2nd edition, pp. 559-561.

*Primary Examiner*—Hai H Huynh
(74) *Attorney, Agent, or Firm*—King & Spalding L.L.P.

(57) ABSTRACT

For operating an internal combustion engine a respective lambda adaptation value (LAM_AD) assigned to a respective temperature range is adapted as a function of at least one corrective signal proportion of a lambda controller in relation to a control parameter of the lambda controller if a predetermined condition is fulfilled. The respective lambda adaptation value (LAM_AD) is assigned a respective reference temperature If a predetermined test condition is fulfilled, a check is made as to which of the lambda adaptation values (LAM_AD) was adapted as a function of the at least one corrective signal proportion since the test condition was last fulfilled. A respective lambda adaptation value not adapted as a function of the at least one corrective signal is compared to a range of valid values. If it lies outside the predetermined diverging range of valid values, the non-adapted lambda adaptation value ($LAM_{13}$ AD) is adapted in a defined manner.

8 Claims, 5 Drawing Sheets

METHOD AND DEVICE FOR OPERATING AN INTERNAL COMBUSTION ENGINE

CROSS-REFERENCE TO RELATED APPLICATIONS

This application claims priority to DE Patent Application No. 10 2008 009 033.6 filed Feb. 14, 2008, the contents of which is incorporated herein by reference in its entirety.

TECHNICAL FIELD

The underlying object of the invention is to create a method and a device for operating an internal combustion engine.

BACKGROUND

Ever more stringent regulations regarding permissible pollutant emissions by motor vehicles fitted with internal combustion engines make it necessary to keep the pollutant emissions as low as possible during operation of the internal combustion engine. One of the ways in which this can be done is by reducing the emissions which occur during the combustion of the air/fuel mixture in the relevant cylinder of the internal combustion engine. Another is to use exhaust gas post processing systems in internal combustion engines which convert the emissions which are generated during the combustion process of the air/fuel mixture in the relevant cylinder into harmless substances. Catalytic converters are used for this purpose which convert carbon monoxide, hydrocarbons and nitrous oxide into harmless substances.

Both the explicit influencing of the generation of the pollutant emissions during the combustion and also the conversion of the pollutant components with a high level of efficiency by an exhaust gas catalytic converter require a very precisely set air/fuel ratio in the respective cylinder.

A linear closed-loop Lambda control with a linear Lambda probe which is arranged upstream from an exhaust gas catalytic converter and a binary Lambda probe which is arranged downstream of the exhaust gas catalytic converter is known from the German textbook, "Handbuch Verbrennungsmotor (Internal Combustion Engine Handbook)", published by Richard von Basshuysen, Fred Schäfer, 2nd Edition, Vieweg & Sohn Verlagsgesellschaft mbH, June 2002, Pages 559-561. A Lambda setpoint value is filtered by means of a filter which takes account of gas delay times and the sensor behavior. The Lambda setpoint value filtered in this way is the closed-loop control variable of a $PII^2D$ Lambda controller, for which the manipulated variable is an injection volume correction.

Furthermore a binary Lambda controller is also known from the same textbook on the same page, with a binary Lambda probe which is arranged upstream of the exhaust gas catalytic converter. The binary Lambda controller comprises a PI closed-loop controller, with the P- and I proportions being held in engine maps covering engine speed and load. With the binary Lambda controller the excitation of the catalytic converter CC, also known as the Lambda fluctuation, is implicitly produced by the two-level control. The amplitude of the Lambda fluctuation is set to around 3%.

DE 103 07 004 B3 discloses extracting, as function of the temperature of the internal combustion engine, an adaptation value for the required fuel amount of a characteristic curve and checking during Lambda control whether predetermined adaptation conditions exist. If they do, an adaptation value is determined from the controller parameters of the Lambda control and the characteristic curve is adapted as a function of the newly determined adaptation value and the measured temperature of the internal combustion engine.

The underlying object of the invention is to create a method and a device for operating an internal combustion engine which are respectively simple and also precise.

The object is achieved by the features of the independent claims. Advantageous embodiments of the invention are identified in the subclaims.

One embodiment of the invention is characterized by a method or a corresponding device for operating an internal combustion engine with at least one a cylinder with a combustion chamber, an injection valve, which is designed for metering of fuel. A Lambda controller is provided. A Lambda adaptation value assigned to a respective temperature range is adapted as a function of at least one corrective signal of the Lambda controller with regard to a control parameter of Lambda controller and this is done if a respective predetermined condition is fulfilled which demands that a quasi-stationary operating state obtains and the respective temperature range is adopted. The respective Lambda adaptation value is assigned to a respective reference temperature in the respective temperature range. A fuel mass to be metered is determined as a function of at least one operating variable of the internal combustion engine. The fuel mass to be metered is corrected as a function of the respective Lambda adaptation value assigned to the current temperature. If a predetermined test condition is fulfilled a check is made as to which of the Lambda adaptation values was adapted as a function of the at least one corrective signal proportion since the test condition was last fulfilled. In addition a Lambda adaptation value not adapted as a function of the at least one respective corrective value which, as regards its respective assigned temperature range, is adjacent to a respective Lambda adaptation value adapted by the at least one corrective signal proportion, is checked as to whether it lies in a range of valid values, which diverges in a predetermined manner as regards the reference temperature of the respective adjacent adapted Lambda adaptation value starting from the respective adapted Lambda adaptation value.

If it lies outside the predetermined diverging range of valid values, the non-adapted Lambda adaptation value will be adapted so that it lies at approximately the closest boundary of the range of valid values in relation of its value before adaptation.

In this way it can be easily ensured that Lambda adaptation values which, between two consecutive times at which the predetermined checking condition is fulfilled, could not be adapted as a function of the corrective signal of the Lambda controller, can then still be adapted.

In this context use is made of the knowledge that a certain correlation exits between the Lambda adaptation values and thus an adaptation of a respective Lambda adaptation value as a function of the at least one corrective signal proportion of the Lambda controller can be used in respect of the one control parameter in order to also adapt the respective adjacent Lambda adaptation value if this not has not been adapted previously as a function of the corrective signal proportion.

This enables a simple contribution to be made to supplying the Lambda adaptation values with the most precise data possible and thus setting the air/fuel-ratio in the respective combustion chamber precisely.

The predetermined checking condition can for example be fulfilled as a function of time.

In accordance with an advantageous embodiment the respective range of validity values is predetermined in a V shape starting from the respective adapted Lambda adaptation value. In this way the respective range of validity values can be computed especially easily and the respective parameters for its definition need relatively little storage space.

In accordance with a further advantageous embodiment a respective non-adapted adaptation value, which has two neighboring values as regards temperature, will be checked as regards two respective Lambda adaptation values depending on the at least one corrective signal proportion as to whether it lies in at least in one of the ranges of valid values, which diverge in a predetermined manner as regards the temperature starting from the respective adapted Lambda adaptation value. If it lies outside one of the two predetermined diverging ranges of valid values in each case, the respective non-adapted Lambda adaptation value is adapted so that it lies approximately at the closest boundary as regards it value before the adaptation of the two respective ranges of valid values. In this way an especially simple and, in the respect of a precise metering of the fuel mass, effective adaptation is possible.

In accordance with a further advantageous embodiment a Lambda adaptation value not adapted as a function of the at least corrective signal proportion, which as regards the temperature range assigned to it, is only indirectly adjacent to a respective Lambda adaptation value adapted as a function of the at least one corrective signal proportion, is checked as to whether it lies in a range of valid values which diverges in a predetermined manner as regards the respective reference temperature starting from the respective adjacent adaptation value. If it lies outside the predetermined diverging range of valid values, the non-adapted Lambda adaptation value will be adapted, so that it is displaced by a proportion defined by a trust factor of a distance to the closest boundary of the range of valid values in the direction of the closest boundary of the range of valid values as regards its value before adaptation. In this way a precise adaptation of only indirectly adjacent adaptation values to a respective Lambda adaptation value adapted as a function of the at least one corrective signal is possible. The trust factor, which can be determined empirically for example, also enables any possible uncertainty that may arise to be taken into account.

In this context it is advantageous, as the indirection of the adjacency to a respective Lambda adaptation value adapted as a function of the at least one corrective signal proportion increases, for the trust factor to be predetermined as a reduced value. In this way use is made of the knowledge that as the indirection increases, an uncertainty as regards the correlation in respect of the range of valid values increases.

In accordance with a further advantageous embodiment, for an immediately adjacent adapted Lambda adaptation value on the one side and an indirectly adjacent further adapted Lambda adaptation value on the other side, the range of valid values of the directly adjacent Lambda adaptation value is considered as definitive and thus the adaptation is undertaken on this basis and this is done especially not taking into account the only indirectly adjacent further adapted Lambda adaptation value and the range of valid values assigned thereto.

In accordance with a further advantageous embodiment the trust factor depends on the distribution of the Lambda adaptation values, which were adapted as a function of the at least one corrective signal proportion. In this way the knowledge can be used that a small distribution of the Lambda adaptation values adapted as a function of the corrective signal is a symptom of the strong dependency of the Lambda adaptation values on the fuel quality and thus for example the trust factor is embodied so that it reduces relatively little, i.e. especially reduces less than with a greater distribution, and does so as the indirection increases. In this way the air/fuel mixture can be set even more precisely.

BRIEF DESCRIPTION OF THE DRAWINGS

Exemplary embodiments of the invention are explained in greater detail below with reference to the schematic drawings. The figures are as follows.

Elements with identical construction or which function in the same way are identified by the same reference symbols in all figures.

DETAILED DESCRIPTION

Figure 1:
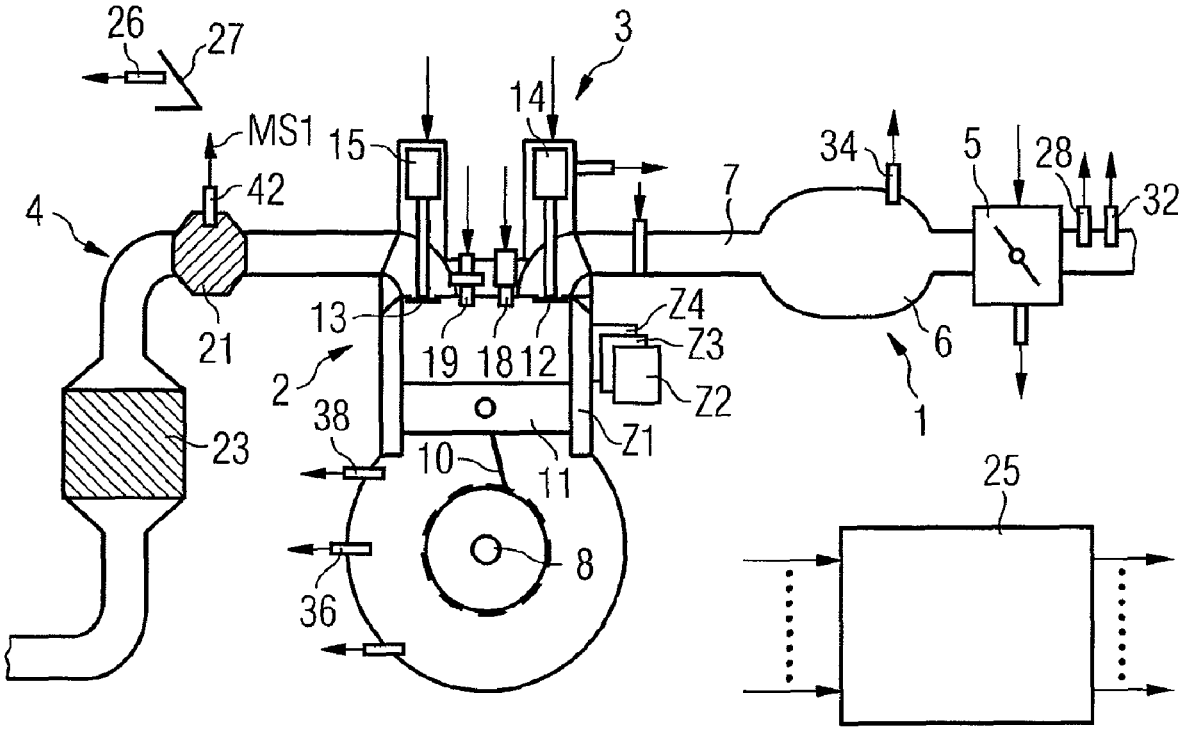
FIG. 1 an internal combustion engine with a control device.

An internal combustion engine (FIG. 1) comprises an induction tract 1, an engine block 2, a cylinder head 3 and an exhaust gas tract 4. The induction tract 1 preferably comprises a throttle valve 5, also a collector 6 and an induction pipe 7 which is routed through to the cylinder Z1 via an inlet channel in the engine block 2. The engine block 2 further comprises a crankshaft 8, which is coupled via a connecting rod 10 to the piston 11 of the cylinder Z1.

The cylinder head 3 includes valve gear with a gas inlet valve 12 and a gas exhaust valve 13.

The cylinder head 3 further comprises an injection valve 18 and a spark plug 19. Alternatively the injection valve 18 can also be arranged in the inlet manifold 7.

An exhaust gas catalytic converter 21 which is embodied as a three-way catalytic converter is arranged in the exhaust gas tract. A further exhaust gas catalytic converter is also preferably arranged in the exhaust gas tract, which is embodied as an NOx exhaust gas catalytic converter 23.

A control device 25 is provided to which sensors are assigned which detect different measurement variables and determine the value of the measurement variable in each case. The control device 25 determines, as a function of at least one of the measurement variables, control variables which are then converted into one or more corrective signals for controlling the adjusting elements by means of corresponding adjusting drives. The control device 25 can also as be referred to as a device for controlling the internal combustion engine.

The sensors are a pedal position sensor 26, which records a position of the gas pedal 27, an air mass sensor 28, which records an air mass flow upstream of the throttle valve 5, a first temperature sensor 32, which records an induction air temperature, an induction manifold pressure sensor 34, which records an induction manifold pressure in the collector 6, a crankshaft angle sensor 36 which records a crankshaft angle which is then assigned to an rpm N.

Furthermore a first exhaust gas probe 42 is provided which is arranged in the three-way catalytic converter 42 and which detects the residual oxygen content of the exhaust gas and of which the measuring signal MS1 is characteristic for the air/fuel ratio in the combustion chamber of the cylinder Z1 and upstream of the first exhaust gas probe before the oxidation of the fuel, referred to below as the air/fuel ratio in the cylinders Z1-Z4. The first exhaust gas probe 42 can be arranged upstream from three-way catalytic converter 21 or arranged in the three-way catalytic converter 21 so that a part of the catalytic converter volume is upstream of the exhaust gas probe 42.

The exhaust gas probe 42 can be a linear Lambda probe or a binary Lambda probe.

Depending on the embodiment of the invention, any subset of said sensors can be present or additional sensors can also be present.

The adjusting elements are for example the throttle valve 5, the gas inlet and gas outlet valves 12, 13, the injection valve 18 or the spark plug 19.

As well as the cylinder Z1, further cylinders Z2 to Z4 are preferably also provided to which corresponding actuators and where necessary sensors are also assigned.

Figure 2:
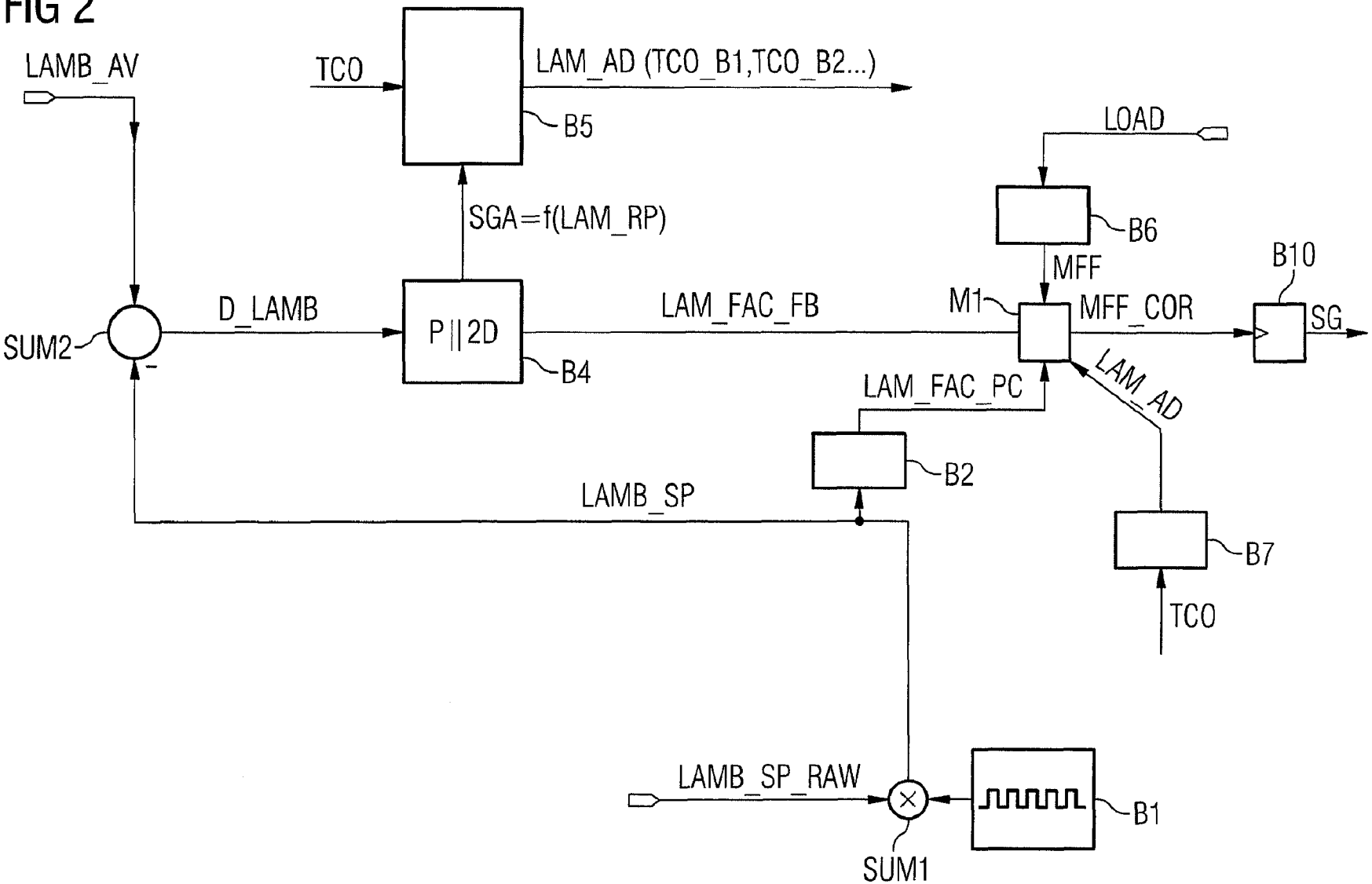
FIG. 2 a block diagram of a part of the control facility of the internal combustion engine, FIG. 3 a first flowchart for operating the internal combustion engine, FIG. 4 a second flowchart for operating the internal combustion engine, FIG. 5 a first adaptation scheme for the Lambda adaptation values and FIG. 6 a second adaptation scheme for the Lambda adaptation values.

A block diagram of a part of the control device 25 in accordance with a first embodiment is shown in FIG. 2. A predetermined raw air/fuel ratio LAMB SP_RAW can be established in an especially simple embodiment. It is however preferably determined for example as a function of the current operating mode of the internal combustion engine, such as homogenous or stratified injection operation and/or as a function of operating variables of the internal combustion engine. In particular the predetermined raw air/fuel ratio LAMB_SP_RAW can be predetermined as approximately the stoichiometric air/fuel ratio. Operating variables include measurement variables and variables derived from these.

In a block B1 a force excitation is determined and in summed in the first summing point SUM1 with the predetermined raw air/fuel ratio LAMB_SP_RAW. The forced excitation is a square-wave signal. The output variable of the summing point is then a predetermined air/fuel ratio LAMB_SP in the combustion chambers of the cylinders Z1 to Z4. The air/fuel ratio LAMB_SP is fed to a block B2 which contains a pilot control and creates a Lambda pilot control factor LAMB_FAC_PC depending on the air/fuel ratio LAMB_SP.

In a second summing point SUM2, depending on the predetermined air/fuel ratio LAMB_SP and the detected air/fuel ratio LAMB_AV by forming a difference a control difference D_LAMB is determined which is an input variable in a block B4. A linear Lambda controller is embodied in block B4 and is preferably embodied as a $PII^2D$ controller. The corrective signal of the linear Lambda controller of the block B4 is a Lambda control factor LAM_FAC_FB.

The Lambda controller of the block B4 is embodied to form the corrective signal of the Lambda controller which for example is the Lambda control factor LAM_FAC_FB by merging a number of corrective signal proportions SGA of the Lambda controller with regard to one control parameter LAM_RP of the Lambda controller in each case. The control parameter is for example a proportional parameter, an integral parameter, an $I^2$ parameter or a differential parameter In this case the corrective signal proportion SGA is produced in each case by the computing operation assigned to each control parameter LAM_RP, i.e. for example in the case of the I parameter by integrating the product of the I parameter and control difference D_LAM.

A block B5 is provided to which, as well as the at least one corrective signal proportion SGA, a temperature TCO is fed, which is especially representative of the motor temperature and thus is especially representative for a coolant temperature.

In block B5 a Lambda adaptation values LAM_AD assigned to a respective temperature range TCO_B1 to TCO_B4 is adapted as a function of at least the one corrective signal proportion SGA of the Lambda controller in relation to one of the control parameters LAM_RP of the Lambda controller if a respective predetermined condition is fulfilled. The process relating to this block is explained below with reference to the flowchart of FIG. 3.

A block B6 is also provided, in which, depending on at least one operating variable BG of the internal combustion engine, which for example can represent a load LOAD and for example can be an air mass flow and/or also the speed N, a fuel mass MFF to be metered is determined.

A block B7 is also provided, in which, depending on the temperature TCO, the assigned Lambda adaptation value LAM_AD is selected and output through to a correction block M1 on the output side.

In the correction block M1 a corrected fuel mass MFF_COR to be metered is formed and this is done for example by forming the product of the fuel mass MFF to be metered, the Lambda pilot control factor LAM_FAC_PC, the Lambda control factor LAM_FAC_FB and of the Lambda adaptation factor LAM_AD. Depending on the embodiment a correction factor can also be determined as a function of sum of the Lambda pilot factor LAM_FAC_PC, the Lambda control factor LAM_FAC_FB and the Lambda adaptation value LAM_AD for example, which is then multiplicatively logically combined with the fuel mass MFF to be metered. The corrected fuel mass MFF_COR to be metered determined in correction block M1 is them converted in a block B10 into a corrective signal SG for actuating the injection valve 18.

Alternatively the controller can also be embodied as a binary Lambda controller, as is likewise disclosed for example in the Handbuch Verbrennungsmotor text book mentioned above, the contents of which are thus included in this connection.

Figure 3:
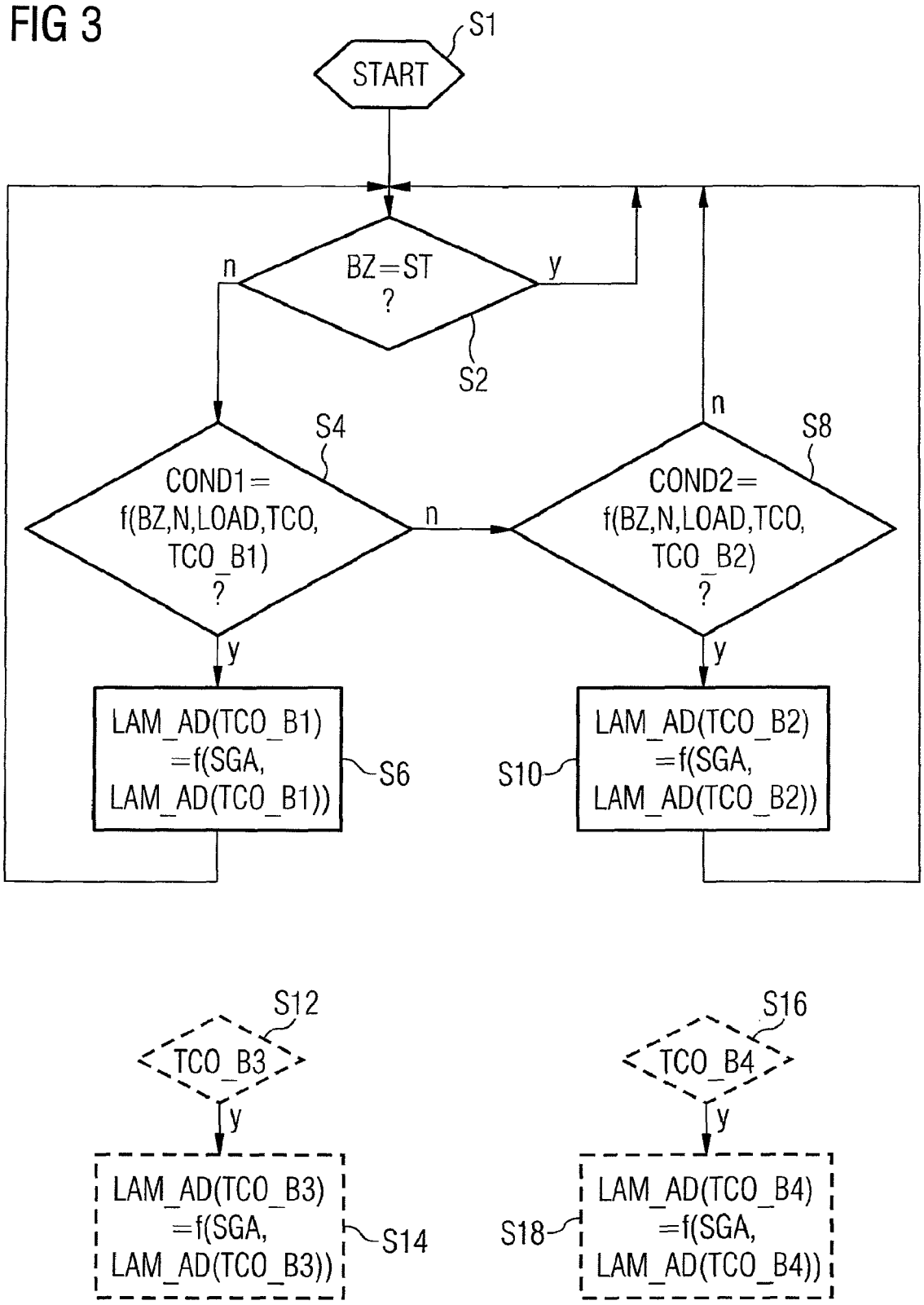

The flowchart in accordance with FIG. 3 is started in a step S1 especially very close to and thus especially on starting the internal combustion engine. Variables can be initialized if necessary in step S1.

In a step S2 a check is made as to whether the operating state BZ of the internal combustion engine is Start ST. If its is, the processing, if necessary after a predeterminable wait time or a predeterminable crankshaft angle, is continued in step S2.

If the condition of step S2 is not fulfilled however, a check is performed in a step S4 as to whether a predetermined condition and indeed a first predetermined condition COND1 is fulfilled, which requires the operating state BZ to be a quasi-stationary operating state and a first temperature range TCO_B1 is adopted.

The condition can for example also still depend on a speed and/or a load variable LOAD. To fulfill the condition it can under some circumstances also be necessary for the engine speed N to be within a specific speed range and also the load variable LOAD to be within a specific predetermined range or for these variables only to change for a predetermined period around a predetermined small value.

The quasi-stationary state is especially characterized in that the speed N changes from slightly through to essentially not at all and/or the same also applies to the load variable LOAD.

If the predetermined condition of the step S4, i.e. the first predetermined condition COND1 is fulfilled, in a step S6 the Lambda adaptation value LAM_AD assigned to the respective temperature range which is identified by a corresponding bracketed reference symbol of the respective temperature range, i.e. in this case of the first temperature range TCO_B1, is adapted as a function the corrective signal proportion SGA and the previous value of the respective Lambda adaptation value LAM_AD. In this case for example the adaptation can be undertaken in the form of filtering by means of generating a sliding average value and a predetermined proportion of the corrective signal proportion SGA can be transferred to the Lambda adaptation value LAM_AD. Accordingly a corresponding resetting of the corrective signal proportion SGA is then undertaken in the controller of block B4.

After step S6 has been processed processing is continued again in step S2, if necessary after the predetermined waiting time or the predetermined crankshaft angle. If the first condition COND1 of the step S4 is not fulfilled, the predetermined conditions of the step S8 and indeed the second predetermined condition COND2 is checked, which differs from the first predetermined condition COND2 in that it can only be fulfilled if a second temperature range TCO_B2 is adopted.

If the condition of step S8 is not fulfilled, the processing is continued as after step S6 in step S2. If the condition of step S8 is fulfilled on the other hand, a step S10 is processed, in which the Lambda adaptation value LAM_AD assigned to the second temperature range TCO_B2 is adapted in accordance with the process according to step S6. Here too there is a corresponding subsequent adaptation of the corrective signal proportion SGA in block B4.

If corresponding assigned Lambda adaptation values are provided for more than two temperature ranges, corresponding additional predetermined conditions are specified, on the fulfillment of which a corresponding adaptation of the respective Lambda adaptation values LAM_AD is undertaken.

For example it is also specified whether a third temperature range TCO_B3 and/or a fourth temperature range TCO_B4 is provided. In the case of the third temperature range TCO_B3 a step S12 is provided, which is executed on non-fulfillment of the second condition of the step S8 and the third condition of which differs from the first condition COND1 in that the fulfillment of the third condition requires the third temperature range to be adopted. The respective Lambda adaptation value LAM_AD is then adapted accordingly in a step S14 corresponding to the step S6. If the condition of step S12 is not fulfilled, in the case of a fourth temperature range TCO_B4 step S16 can be processed, of which the fourth condition differs from the first condition of the step S4, in the condition for its fulfillment is that the temperature lies in the fourth temperature range TCO_B4. If the condition of the step S16 is fulfilled, a step S18 is then executed in which the respective assigned Lambda adaptation value LAM_AD is adapted in accordance with process of step S6. If no further temperature range is provided, then, if the condition of step S16 is not fulfilled, processing is continued in step S2.

In real driving mode it can occur that, despite the engine running for a long period, one or more of the predetermined conditions are not fulfilled a single time and thus no corresponding adaptation of the respective assigned Lambda adaptation values LAM_AD occurs.

Figure 4:
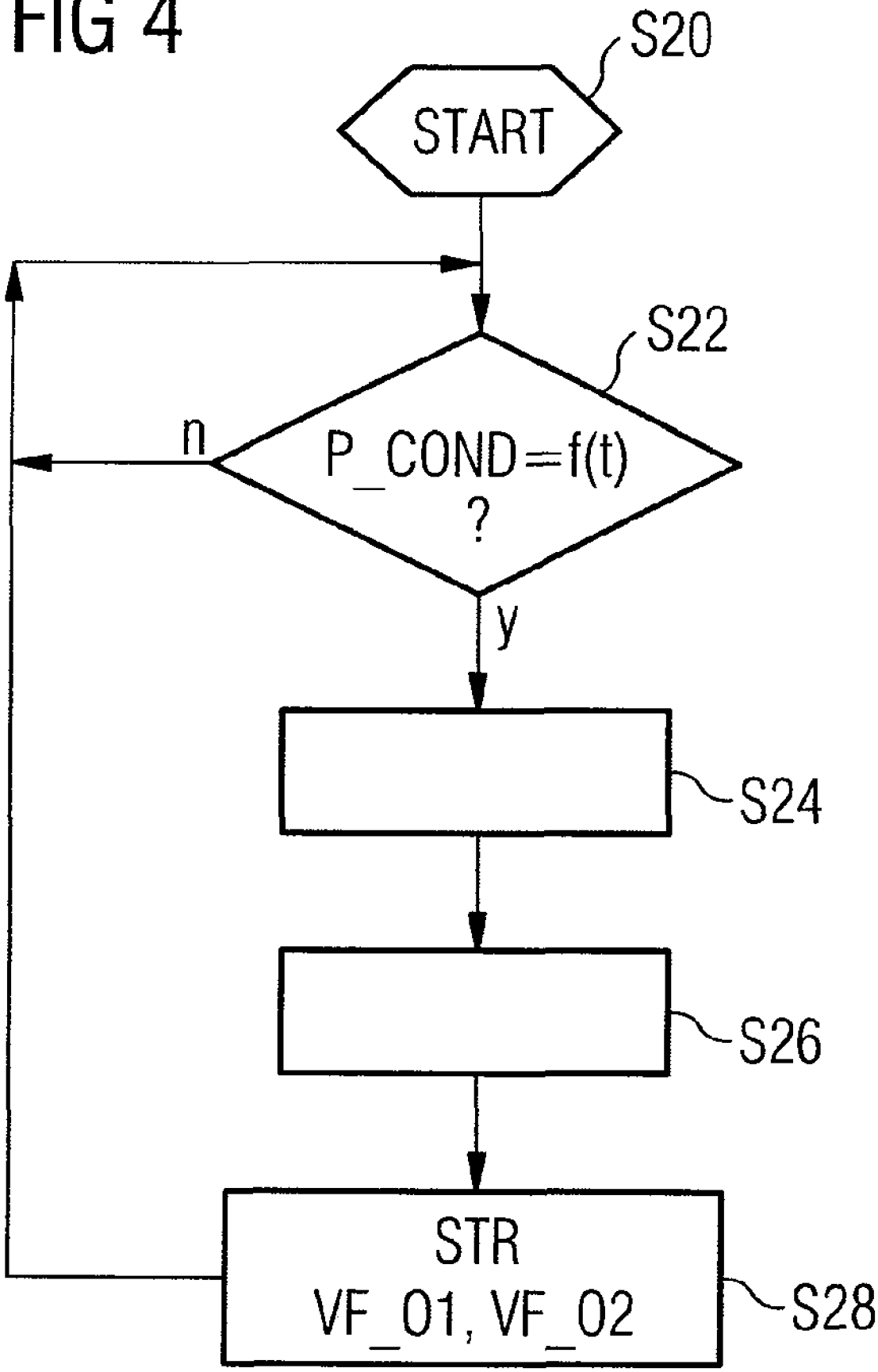

A program in accordance with of the flowchart of FIG. 4 can for example also be processed in block B5. The program is started in a step S20, in which for example variables can be initialized. The process can be started for example close to the time at which the internal combustion engine starts.

In a step S22 a check is made as to whether a predetermined checking condition P_COND is fulfilled. The predetermined checking condition can for example depend on the time t and be fulfilled for example after a predetermined period. In this case the predetermined period can amount to around 15 minutes for example. It can for example also be fulfilled once for example at an end of a respective engine run or exhibit a respective suitable temporal context.

If the condition of step S22 is not fulfilled, the processing, is continued if necessary after the predetermined waiting time or the predetermined crankshaft angle, is continued again in the step S22. By contrast, if the condition of step S22 is fulfilled, it is determined in a step S24, which of the adaptation values LAM_AD was adapted since the last time that step S24 was executed by means of the program according to the flowchart of FIG. 3.

Then in a step S26 the Lambda adaptation value LAM_AD not adapted as a function of the respective at least one corrective signal proportion SGA, which is adjacent with regard to its respective assigned temperature range is adapted to a Lambda adaptation value LAM_AD adapted as a function of the at least one corrective signal SGA by checking whether it lies within a range of valid values, which diverges as regards the reference temperature of the respective adjacent predetermined adapted Lambda adaptation value LAM_AD starting from the respective adapted Lambda adaptation value LAM_AD. If it lies outside the predetermined diverging range of valid values, the non-adapted Lambda adaptation value LAM_AD is adapted, so that it lies approximately at the closest boundary of the range of valid values in relation to its value before adaptation.

Preferably, if a respective non-adapted Lambda adaptation value LAM_AD as regards the temperature TCO is adjacent on both sides to two respective Lambda adaptation values LAM_AD adapted as a function of the at least one corrective signal proportion, a check is made as to whether the respective non-adapted Lambda adaptation value LAM_AD lies at least in one of the ranges of valid values, which in relation to the temperature TCO diverge in a predetermined manner starting from the respective adapted Lambda adaptation value LAM_AD.

If it lies outside one of the two predetermined diverging ranges of valid values in each case, the respective non-adapted Lambda adaptation LAM_AD is adapted, so that it lies approximately at the closest boundary as regards its value before the adaptation of the two respective ranges of valid values.

Preferably in the case of a directly adjacent adapted Lambda adaptation value LAM_AD on one side and only an indirectly adjacent further adapted Lambda adaptation value LAM_AD on the other side, the range of valid values of the directly adjacent Lambda adaptation value LAM_AD is included as definitive.

Figure 5:
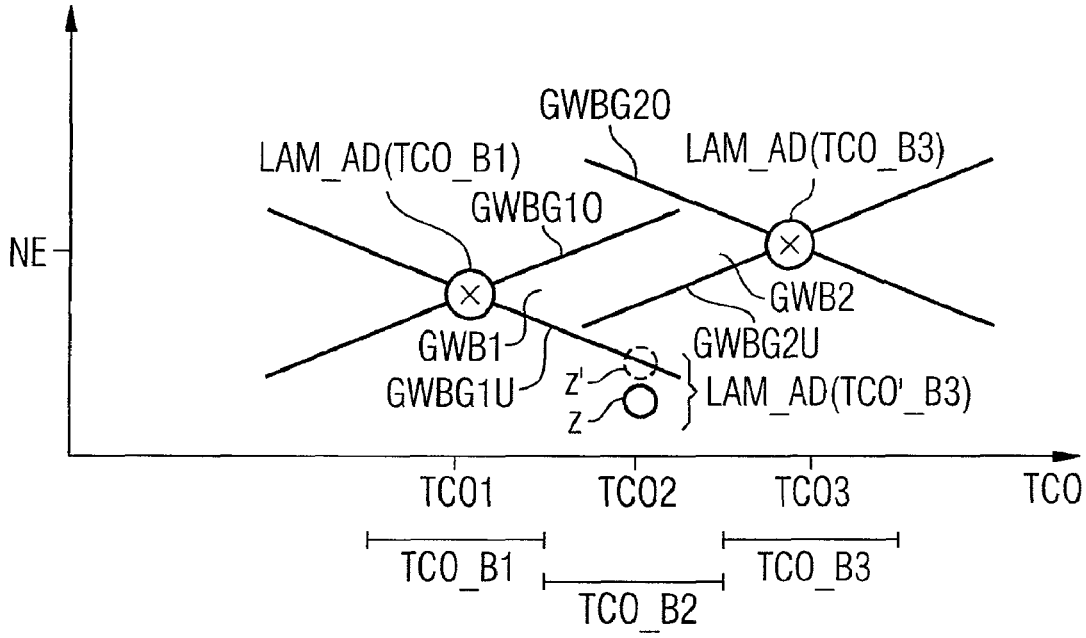
Figure 6:
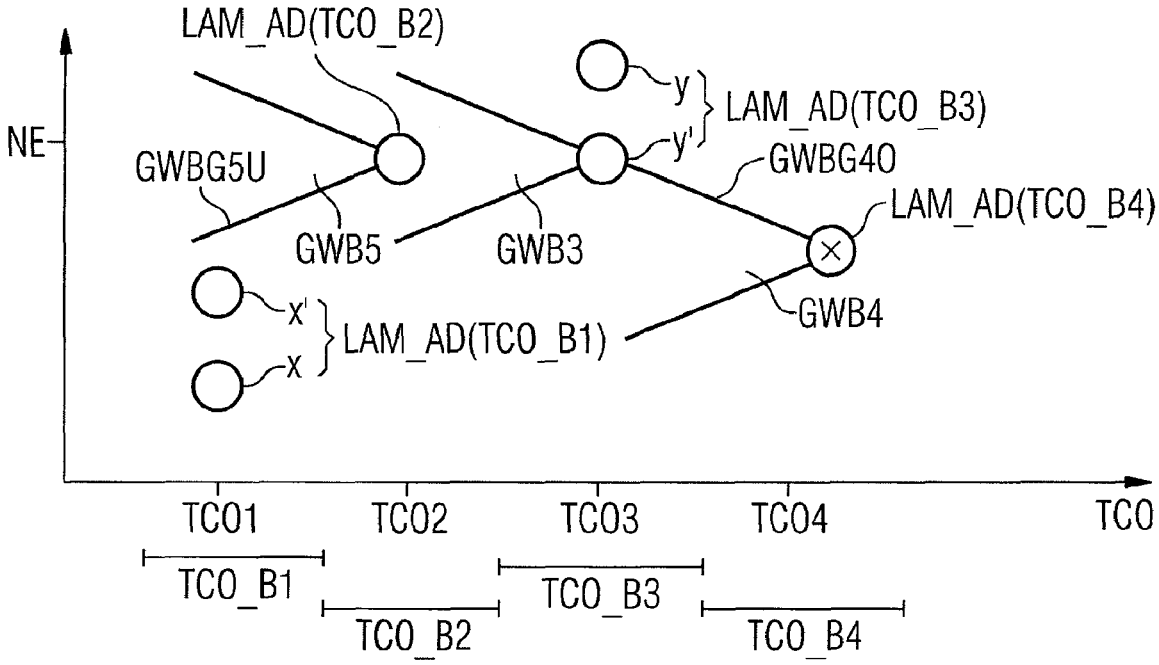

A processing scheme is explained in greater detail on the basis of the exemplary embodiments of FIGS. 5 and 6.

In a step S26 a Lambda adaptation value LAM_AD not adapted as a function of the at least one corrective signal proportion SGA, which in relation to the temperature range assigned to it, is only indirectly adjacent to a respective Lambda adaptation value LAM_AD adapted as a function of the at least one corrective signal proportion, is checked as to whether it lies in a range of valid values which diverges in a predetermined manner in relation to the respective reference temperature starting from the respective adjacent Lambda adaptation value LAM_AD.

If it lies outside the predetermined diverging range of valid values, the non-adapted Lambda adaptation value LAM_AD will be adapted, so that it is displaced by a proportion defined by a trust factor VF_01, VF_02 of a distance to the closest boundary of the range of valid values in the direction of the closest boundary of the range of valid values in relation to its value before adaptation.

Preferably the trust factor VF_01, VF_02 is predetermined reduced as the indirect nature of the adjacency to a Lambda adaptation value LAM_AD adapted as a function of the at least one corrective signal proportion SGA increases. In such cases the trust factor can for example be fixed in each case or for example also be determined as a function of a distribution of the Lambda adaptation value LAM_AD which was adapted as a function of the at least one corrective signal proportion SGA.

A corresponding adaptation scheme is explained in greater detail with reference to FIG. 6.

Preferably the respective ranges of valid values which each diverge in a predetermined manner in relation to the reference temperature of the respective adapted Lambda adaptation value LAM_AD starting of the respective adapted Lambda adaptation value, are predetermined in a V shape, as is shown by way of example in FIGS. 5 and 6.

In FIG. 5 first, second and third temperature ranges TCO_B1, TCO_B2, TCO_B3 and correspondingly assigned Lambda adaptation values LAM_AD are plotted as examples, with the temperature TCO being plotted on the abscissa and the respective values of the Lambda adaptation value LAM_AD being plotted on the ordinate, with NE a designating a neutral value. The respective Lambda adaptation values LAM_AD are assigned respective reference temperatures TCO1, TCO2, TCO3 which are located within the respective temperature ranges TCO_B1 to TCO_B3. The Lambda adaptation values LAM_AD are represented by small circles. The small circles are identified by a cross in the cases, in which an adaptation of the respective Lambda adaptation value LAM_AD has occurred in the interval since the last time that the test condition P_COND was fulfilled, depending on the corrective signal proportion SSA.

Within the framework of the processing of step S26 it is established in this example that the Lambda adaptation value LAM_AD, which is assigned to the second temperature range TCO_B2, lies with its non-adapted value Z both outside a first range of valid values GWB1 and also outside a second range of valid values GWB2. The first range of valid values is assigned to the Lambda adaptation value LAM_AD, which is assigned to the first temperature range TCO_B1 and has boundaries GWBG10 and GWBG1U. The second range of valid values GWB2 is assigned to the Lambda adaptation value LAM_AD which is assigned to the third temperature range TCO_B3.

Since the value Z of the Lambda adaptation value LAM_AD, which is assigned to the second temperature range TCO_B2 lies outside both the first and also the second range of valid values GWB1, GWB2, this will be displaced to the boundary GWBG1U of the first range of valid values GWB1 and then has a value Z'.

In accordance with FIG. 6 a case with four Lambda adaptation values LAM_AD is shown, in which only the Lambda adaptation value LAM_AD assigned to the fourth temperature range TCO_B4 has been adapted since the last time that the test condition P_COND was fulfilled, as a function of the at least one corrective signal proportion SGA. In this case the value Y of the Lambda adaptation value LAM_AD, which is assigned to the third temperature range TCO_B3 is first adapted to a value Y', according to the process of the step S26 at the boundary GWBG4O of the Lambda adaptation value LAM_AD in relation to the fourth range of valid values GWB4 assigned to the fourth temperature range TCO_B4.

Starting from the Lambda adaptation value LAM_AD of the third temperature range TCO_B3 represented by the value Y', by means of the process of step S26 starting from the reference temperature TCO3, a diverging third range of valid values GWB3 is spanned in the direction through to the second temperature range TCO_B2. Since the Lambda adaptation value LAM_AD which is assigned to the second temperature range TCO_B2 lies within the third range of valid values GWB3, this is not further adapted. Starting from the Lambda adaptation value LAM_AD which is assigned to the second temperature range TCO_B2, starting from its reference temperature TCO2, a fifth range of valid values GWBS through to the first temperature range TCO_B1 is spanned. On the basis of the method in accordance with step S26 it can then be established that the value X of the Lambda adaptation value LAM_AD, which is assigned to the first temperature range TCO_B1, lies outside the fifth range of valid values GWB5. The Lambda adaptation value LAM_AD is then adapted taking into account the assigned trust factor VF_O2 and thus a reduction in the distance of the value X' of the Lambda adaptation value LAM_AD thus adapted, which is assigned to the first temperature range TCO_B1 from a lower boundary GWBG5U of the fifth range of valid values GWB5.

What is claimed is:

1. A method for operating an internal combustion engine with at least one cylinder with a combustion chamber, an injection valve which is designed for metering fuel, with a lambda controller being provided in which:

a respective lambda adaptation value (LAM_AD) assigned to a respective temperature range is adapted as a function of at least one corrective signal proportion (SGA) of the lambda controller in relation to a control parameter (LAM_RP) of the lambda controller if a respective predetermined condition is fulfilled, which requires that a quasi-stationary operating state is present and the respective temperature range is adopted, with the respective lambda adaptation value (LAM_AD) being assigned to a respective reference temperature in the respective temperature range, a fuel mass (MFF) m to be metered is determined as a function of at least one operating variable (BG) of the internal combustion engine, the fuel mass (MFF) to be metered is corrected as a function of the respective lambda adaptation value (LAM_AD) assigned to the current temperature, and if a predetermined test condition (P_COND) is fulfilled:

a check is performed as to which of a number of lambda adaptation values (LAM_AD) was adapted as a function of the at least one corrective signal proportion since the test condition (P_COND) was last fulfilled, a respective lambda adaptation value (LAM_AD) not adapted as a function of the at least one corrective signal proportion (SGA), which in relation to a respective assigned temperature range is adjacent to a respective lambda adaptation value (LAM_AD) adapted as a function of the at least one corrective signal proportion (SGA), is checked as to whether it lies in a range of valid values which diverges in a predetermined manner in relation to the reference temperature of the respective adjacent adapted lambda adaptation value (LAM_AD) starting from the respective adapted lambda adaptation value, and if it lies outside the predetermined diverging range of valid values, the non-adapted lambda adaptation value (LAM_AD) is adapted so that it lies approximately at the closest boundary of the range of valid values in relation to its value before the adaptation.

2. The method as claimed in claim 1, in which the respective range of valid values is predetermined in a V shape starting from the respective adapted lambda adaptation value (LAM_AD).

3. The method as claimed in one of the previous claims, in which a respective non-adapted adaptation value (LAM_AD), which in relation to the temperature is adjacent on both sides to two respective lambda adaptation values (LAM_AD) adapted as a function of the at least one corrective signal proportion (SGA) is checked as to whether it lies at least in one of the ranges of valid values which diverge in a predetermine manner in relation to the temperature starting from the respective adapted lambda adaptation value (LAM_AD), if it lies outside the respective two predetermined diverging ranges of valid values, the respective non-adapted lambda adaptation value (LAM_AD) is adapted so that it lies approximately at the closest boundary of the respective two ranges of valid values in relation to its value before the adaptation.

4. The method as claimed in one of the previous claims, in which a lambda adaptation value (LAM_AD) not adapted as a function of the at least one corrective signal proportion, which in relation to the temperature range assigned to it is only indirectly adjacent to a respective lambda adaptation value (LAM_AD) adapted as a function of the at least one corrective signal proportion (SGA) is checked as to whether it lies in a range of valid values which, in relation to the respective reference temperature, diverges in a predetermined manner starting from the respective adjacent lambda adaptation value (LAM_AD), if it lies outside the predetermined diverging range of valid values, the non-adapted lambda adaptation value (LAM_AD) is adapted so that it is displaced by a proportion of a distance defined by a trust factor to the closest boundary of the range of valid values in the direction of the closest boundary of the range of valid values in relation to its value before the adaptation.

5. The method as claimed in claim 4, in which with increasing indirectness of the adjacency to a respective lambda adaptation value adapted as a function of the at least one corrective signal proportion (SGA), the trust factor is predetermined as a reduced factor.

6. The method as claimed in claim 5, in which the trust factor depends on a distribution of the lambda adaptation values, which were adapted as a function of the at least one corrective signal proportion (LAM_RP).

7. The method as claimed in one of the previous claims, in which, for a directly adjacent adapted lambda adaptation value (LAM_AD) on the one side and an indirectly adjacent further adapted lambda adaptation value (LAM_AD) on the other side, the range of valid values of the directly adjacent lambda adaptation value (LAM_AD) is definitive.

8. A device for operating an internal combustion engine with at least one a cylinder with a combustion chamber, an injection valve which is designed for metering of fuel, with a lambda controller being provided, with the device being embodied:

to adapt a respective lambda adaptation value (LAM_AD) assigned to a respective temperature range as a function of at least one corrective signal proportion (SGA) of the lambda controller in relation to a control parameter (LAM_RP) of the lambda controller if a respective predetermined condition is fulfilled, which requires that a quasi-stationary operating state obtains and the respective temperature range is adopted, with the respective lambda adaptation value (LAM_AD) being assigned to a respective reference temperature in the respective temperature range, to determine a fuel mass (MFF) to be metered as a function of at least one operating variable (BG) of the internal combustion engine, to correct the fuel mass (MFF) to be metered as a function of the respective lambda adaptation value (LAM_AD) assigned to the current temperature, and if a predetermined test condition (P_COND) is fulfilled:

to check which of a number of lambda adaptation values (LAM_AD) was adapted as a function of the at least one corrective signal proportion since the test condition (P_COND) was last fulfilled, to test a respective lambda adaptation value (LAM_AD) not adapted as a function of the at least one corrective signal proportion (SGA), which, in relation to a respective assigned temperature range is adjacent to a respective lambda adaptation value (LAM_AD) adapted as a function of the at least one corrective signal proportion (SGA) as to whether it lies in a range of valid values, which in relation to the reference temperature of the respective adjacent adapted lambda adaptation value (LAM_AD,) diverges in a predetermined manner starting from the respective adapted lambda adaptation value, and if it lies outside the predetermined diverging range of valid values, to adapt the non-adapted lambda adaptation value (LAM_AD) so that it lies approximately at the boundary of the range of valid values in relation to its value before the adaptation.

* * * * *